US006374514B1

(12) United States Patent
Swigart

(10) Patent No.: US 6,374,514 B1
(45) Date of Patent: Apr. 23, 2002

(54) FOOTWEAR HAVING A BLADDER WITH SUPPORT MEMBERS

(75) Inventor: John F. Swigart, Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 09/526,315

(22) Filed: Mar. 16, 2000

(51) Int. Cl.[7] ..... A43B 13/20; A43B 21/32; A43B 21/26

(52) U.S. Cl. ..... 36/35 B; 36/29; 36/141; 36/37

(58) Field of Search ..... 36/35 B, 35 R, 36/37, 29, 28, 27, 3 B, 141, 71, 36 A

(56) References Cited

U.S. PATENT DOCUMENTS

| | | | |
|---|---|---|---|
| 900,867 | A | 10/1908 | Miller |
| 1,069,001 | A | 7/1913 | Guy |
| 1,240,153 | A | 9/1917 | Olsen |
| 1,304,915 | A | 5/1919 | Spinney |
| 1,323,610 | A | 12/1919 | Price |
| 1,514,468 | A | 11/1924 | Schopf |
| 1,584,034 | A | 5/1926 | Klotz |
| 1,625,582 | A | 4/1927 | Anderson |
| 1,625,810 | A | 4/1927 | Krichbaum |
| 1,869,257 | A | 7/1932 | Hitzler |
| 1,916,483 | A | 7/1933 | Krichbaum |
| 1,970,803 | A | 8/1934 | Johnson |
| 2,004,906 | A | 6/1935 | Simister |
| 2,080,469 | A | 5/1937 | Gilbert |
| 2,086,389 | A | 7/1937 | Pearson |
| 2,269,342 | A | 1/1942 | Johnson |
| 2,365,807 | A | 12/1944 | Dialynas |
| 2,488,382 | A | 11/1949 | Davis |
| 2,546,827 | A | 3/1951 | Lavinthal |
| 2,600,239 | A | 6/1952 | Gilbert |
| 2,645,865 | A | 7/1953 | Town |
| 2,677,906 | A | 5/1954 | Reed |
| 2,703,770 | A | 3/1955 | Melzer |
| 2,748,401 | A | 6/1956 | Winstead |
| 2,762,134 | A | 9/1956 | Town |
| 3,030,640 | A | 4/1962 | Gosman |
| 3,048,514 | A | 8/1962 | Bentele et al. |
| 3,120,712 | A | 2/1964 | Menken |
| 3,121,430 | A | 2/1964 | O'Reilly |
| 3,204,678 | A | 9/1965 | Worcester |
| 3,251,076 | A | 5/1966 | Burke |
| 3,284,264 | A | 11/1966 | O'Rourke |
| 3,335,045 | A | 8/1967 | Post |

(List continued on next page.)

FOREIGN PATENT DOCUMENTS

| | | |
|---|---|---|
| AT | 181938 | 2/1906 |
| AT | 200963 | 12/1958 |
| DE | 32 34 086 | 9/1982 |
| DE | 92 01 758.4 | 12/1992 |

(List continued on next page.)

OTHER PUBLICATIONS

Sports Research Review, NIKE, Inc., Jan./Feb. 1990.
Brooks Running Catalog, Fall 1991.

*Primary Examiner*—Anthony Stashick
(74) *Attorney, Agent, or Firm*—Banner & Witcoff, Ltd.

(57) ABSTRACT

An article of footwear having a fluid filled cushioning bladder. The bladder comprises indentations and mating inserts in the top and bottom surfaces of the bladder. The inwardly directed indentations abut one another, are attached to one another, and have an ovoid shape. The construction of the indentations provide lateral stability and improved shear compliance by providing an increased contact surface area at the abutment point. The contact area preferably corresponds to the shape of the indentation. Each indentation receives an insert having a corresponding shape. The insert is designed to collapse in response to a compressive load and then recover its shape. The profile of each insert and indentation pair is configured for preferential collapse. That is, the two ends of the ovoid have different stiffnesses, so that one end collapses in response to a smaller compressive load than the other end.

66 Claims, 3 Drawing Sheets

U.S. PATENT DOCUMENTS 3,366,525 A 1/1968 Jackson
3,469,576 A 9/1969 Smith et al.
3,568,227 A 3/1971 Dunham
3,589,037 A 6/1971 Gallagher
3,608,215 A 9/1971 Fukuoka
3,685,176 A 8/1972 Rudy
3,758,964 A 9/1973 Nishimura
3,765,422 A 10/1973 Smith
4,017,931 A 4/1977 Golden
4,054,960 A 10/1977 Pettit et al.
4,115,934 A 9/1978 Hall
4,129,951 A 12/1978 Petrosky
4,167,795 A 9/1979 Lambert, Jr.
4,183,156 A 1/1980 Rudy
4,187,620 A 2/1980 Seiner
4,217,705 A 8/1980 Donzis
4,219,945 A 9/1980 Rudy
4,271,606 A 6/1981 Rudy
4,287,250 A 9/1981 Rudy
4,292,702 A 10/1981 Phillips
4,297,797 A 11/1981 Meyers
4,305,212 A 12/1981 Coomer
4,328,599 A 5/1982 Mollura
4,358,902 A 11/1982 Cole et al.
4,431,003 A 2/1984 Sztancsik
4,446,634 A 5/1984 Johnson et al.
4,458,430 A 7/1984 Peterson
4,483,030 A 11/1984 Plick et al.
4,486,964 A 12/1984 Rudy
4,506,460 A 3/1985 Rudy
4,547,919 A 10/1985 Wang
4,662,087 A 5/1987 Beuch
4,670,995 A 6/1987 Huang
4,686,130 A 8/1987 Kon
4,722,131 A 2/1988 Huang
4,744,157 A 5/1988 Dubner
4,779,359 A 10/1988 Famolare, Jr.
4,782,602 A 11/1988 Lakic
4,803,029 A 2/1989 Iversen et al.
4,817,304 A 4/1989 Parker et al.
4,823,482 A 4/1989 Lakic
4,845,338 A 7/1989 Lakic
4,845,861 A 7/1989 Moumgdgian
4,874,640 A 10/1989 Donzis
4,891,855 A 1/1990 Cheng-Chung
4,906,502 A 3/1990 Rudy
4,910,886 A * 3/1990 Sullivan et al. ..... 36/71
4,912,861 A 4/1990 Huang
4,936,029 A 6/1990 Rudy
4,965,899 A 10/1990 Sekido et al.
4,991,317 A 2/1991 Lakic
4,999,931 A 3/1991 Vermeulen
4,999,932 A 3/1991 Grim
5,022,109 A 6/1991 Pekar
5,025,575 A 6/1991 Lakic
5,042,176 A 8/1991 Rudy
5,044,030 A 9/1991 Balaton
5,046,267 A 9/1991 Kilgore et al.
5,083,361 A 1/1992 Rudy
5,104,477 A 4/1992 Williams et al.
5,155,927 A 10/1992 Bates et al.
5,158,767 A 10/1992 Cohen et al.
5,179,792 A 1/1993 Brantingham
5,193,246 A 3/1993 Huang
5,199,191 A 4/1993 Moumdjian
5,224,277 A 7/1993 Sang Do
5,224,278 A 7/1993 Jeon
5,228,156 A 7/1993 Wang
5,235,715 A 8/1993 Donzis
5,238,231 A 8/1993 Huang
5,245,766 A 9/1993 Warren
5,253,435 A 10/1993 Auger et al.
5,297,349 A 3/1994 Kilgore
5,335,382 A 8/1994 Huang
5,353,523 A 10/1994 Kilgore et al.
5,355,552 A 10/1994 Huang
5,367,791 A 11/1994 Gross et al.
5,406,719 A 4/1995 Potter
5,425,184 A 6/1995 Lyden et al.
5,543,194 A 8/1996 Rudy
5,558,395 A 9/1996 Huang
5,572,804 A 11/1996 Skaja et al.
5,595,004 A 1/1997 Lyden et al.
5,625,964 A 5/1997 Lyden et al.
5,669,161 A 9/1997 Huang
5,686,167 A 11/1997 Rudy
5,713,141 A 2/1998 Mitchell et al.
5,741,568 A 4/1998 Rudy
5,753,061 A 5/1998 Rudy
5,755,001 A 5/1998 Potter et al.
5,771,606 A 6/1998 Litchfield et al.
5,802,739 A 9/1998 Potter et al.
5,830,553 A 11/1998 Huang
5,832,630 A 11/1998 Potter
5,846,063 A 12/1998 Lakic
5,894,683 A * 4/1999 Lin ..... 36/35 B
5,902,660 A 5/1999 Huang
5,907,911 A 6/1999 Huang
5,916,664 A 6/1999 Rudy
5,925,306 A 7/1999 Huang
5,937,462 A 8/1999 Huang
5,952,065 A 9/1999 Mitchell et al.
5,976,451 A 11/1999 Skaja et al.
5,979,078 A 11/1999 McLaughlin
5,987,780 A 11/1999 Lyden et al.
5,993,585 A 11/1999 Goodwin et al.
5,996,254 A * 12/1999 Goven ..... 36/29
6,013,340 A 1/2000 Bonk et al.
6,027,683 A 2/2000 Huang
6,029,962 A 2/2000 Shorten et al.
6,055,746 A 5/2000 Lyden et al.
6,065,150 A 5/2000 Huang
6,092,310 A 7/2000 Schoesler
6,098,313 A 8/2000 Skaja
6,119,371 A 9/2000 Goodwin et al.
6,127,010 A 10/2000 Rudy
6,128,837 A 10/2000 Huang
6,176,025 B1 1/2001 Patterson et al.
6,178,663 B1 * 1/2001 Schoesler ..... 36/29

FOREIGN PATENT DOCUMENTS

EP 0 094 868 5/1983
EP 0 215 974 A1 9/1985
EP 0 605 485 B1 9/1992
EP 0 780 064 A2 6/1997
FR 2144464 1/1973
FR 2404413 4/1979
FR 2407008 5/1979
FR 2483321 4/1981
FR 2614510 4/1987
FR 2.639537 11/1988
GB 14955 of 1893
GB 7441 of 1906
GB 233387 1/1924
GB 978654 12/1964
GB 1128764 10/1968
JP 6-181802 7/1994
JP 266718 9/2000
TW 75100322 1/1975

| | | |
|---|---|---|
| TW | 54221 | 6/1978 |
| WO | WO89/10074 | 11/1989 |
| WO | WO90/10396 | 9/1990 |
| WO | WO91/11928 | 8/1991 |
| WO | WO91/11931 | 8/1991 |
| WO | WO92/08384 | 5/1992 |
| WO | WO95/20332 | 8/1995 |
| WO | WO 98/09546 | 3/1998 |

* cited by examiner

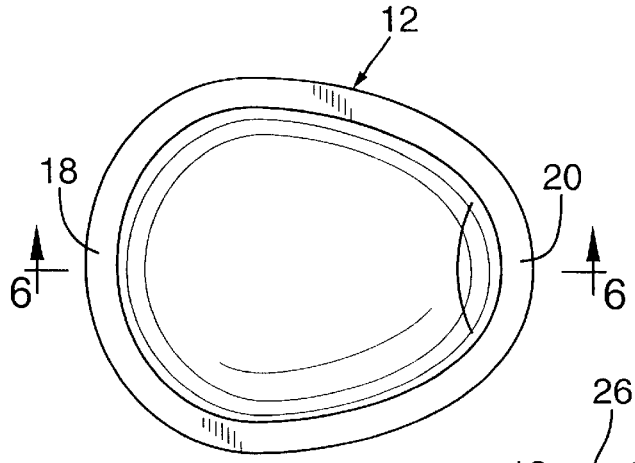
FIG. 4A
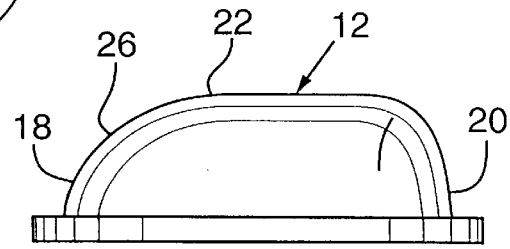
FIG. 5
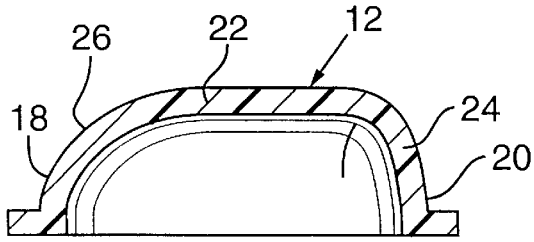
FIG. 6
FIG. 4B
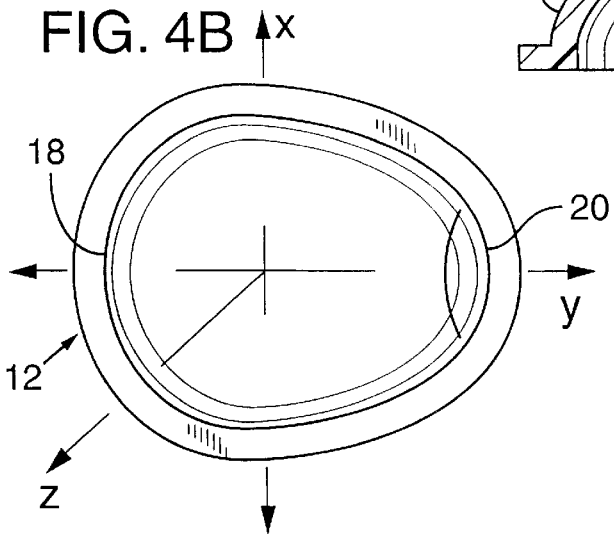
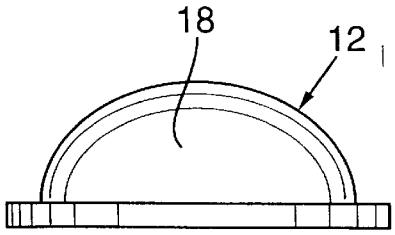
FIG. 8
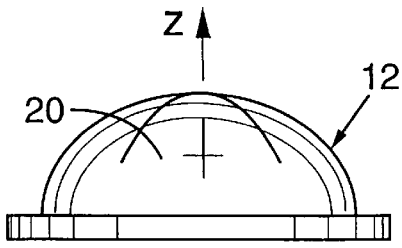
FIG. 7

FOOTWEAR HAVING A BLADDER WITH SUPPORT MEMBERS

FIELD OF THE INVENTION

The present invention relates to footwear, particularly a cushioning member for a shoe sole. More particularly, the cushioning member is a fluid filled component having a plurality of support members configured to differentially collapse in response to a compressive load and provide improved shear compliance.

BACKGROUND OF THE INVENTION

Considerable work has been done to improve the construction of cushioning members which utilize fluid filled bladders such as those used in shoe soles. Although with recent developments in materials and manufacturing methods, fluid filled bladders have greatly improved in versatility, there remain problems associated with obtaining optimum cushioning performance and durability.

One of the advantages of gas filled bladders is that gas as a cushioning compound is generally more energy efficient than open-cell foam typically used in athletic shoe soles. A typical open-celled foam used for midsole components is ethylene-vinyl acetate copolymer (EVA) foam. In many athletic shoes, the entire midsole is comprised of EVA.

Simple gas filled bladders have gas distributed generally within the bladder to provide a uniform cushioning response to a compressive load. Gas filled bladders are also generally moderated with foam to provide the necessary lateral stability to compressive loads applied obliquely as can happen in activities requiring a pushing off motion. In addition, simple gas filled bladders do not provide any means of adjusting or customizing the cushioning characteristics to obtain a softer or stiffer area where desired. Bladders can be formed and inflated so that discrete chambers are at different pressures. Such bladders are disclosed in U.S. Pat. No. 5,353,459 to Potter et al., which is hereby incorporated by reference.

U.S. Pat. No. 5,572,804 to Skaja et al., which is hereby incorporated by reference, discloses a shoe sole component comprising inwardly directed indentations in the top and bottom members of the sole components. Support members or inserts provide controlled collapsing of the material to create areas of cushioning and stability in the component. The inserts are configured to extend into the outwardly open surfaces of the indentations. The indentations can be formed in one or both of the top and bottom members. The indented portions are proximate to one another and can be engaged with one another in a fixed or non-fixed relation. In the Skaja patent, indentations are generally hemispherical in shape and symmetrical about a central orthogonal axis. The outside shape of the indentation, that is, the shape outlined at the surface of the bladder component is circular. The inserts have the same shape as the indentations.

The hemispherical indentations and mating support members or inserts responded to compression by collapsing symmetrically about a center point. While the hemispherical indentations and inserts of Skaja provide for some variation in cushioning characteristics by placement, size and material, there is no provision for biasing or controlling the compression or collapse in a desired direction upon loading.

U.S. Pat. No. 4,670,995 to Huang, which is hereby incorporated by reference, also discloses a shoe sole component comprised of inwardly directed indentations molded into flexible top and bottom sheets. The top and bottom sheets are joined at their outer peripheries, and the top and bottom indentations abut and are connected to one another, so that the top and bottom sheets are held in a spaced relationship and a sealed air cushion is formed. The abutting indentations provide a degree of vertical support and bend under increasing loads.

In addition, the sole of an athletic shoe is subject to very heavy intermittent compression loads and lateral stresses depending upon the activity for which the shoe is designed. For instance, court sports such as tennis and basketball entail quick, side to side movement, jumping and pushing off. The shoes designed for those sports must provide lateral support and have soles which are durable to oblique loads and their attendant shear stresses. For running sports, the shoes must also provide lateral support to prevent excessive pronation or supination, but are mostly subject to cyclic loading of the cushioning element typically beginning with initial lateral side footstrike followed by natural pronation and then supination to toe off. The cushioning element of a running shoe will also be subject to shear stresses in the lateral to medial direction as well as the toe to heel direction.

With hemispherically shaped indentations in the top and bottom of a shoe sole component, the indentations abut one another and are joined together by welding, adhesive or other means. The curved surfaces of the hemispherical indentations which adjoin another indentation are slightly flattened to provide a contact area. The contact area or weld is sized appropriately to the size of the indentations, and with hemispherical indentations, the welds are relatively small. As a result, the welds are a weak area of the sole component when subject to shear stresses, and improved shear stiffness in the sole is desired for durability.

SUMMARY OF THE INVENTION

The present invention pertains to footwear and to a bladder for a shoe sole with preferential collapse and recovery. The bladder of the present invention may be incorporated into a sole assembly of an article of footwear to provide cushioning. The bladder can contain fluid at atmospheric pressure, or can be pressurized. The bladder of the present invention provides for preferential collapse and selective cushioning by the shape and placement of indentations or carriers and mating inserts in the top and bottom surfaces.

The present invention overcomes the enumerated problems with the prior art, including a vulnerability to failure under shear loads.

In accordance with one aspect of the present invention, a bladder is formed of a barrier material with indentations in the top and/or bottom surfaces. When indentations are formed in both surfaces, the indentations abut one another and join one another in a contact area. At either the top or bottom surface of the bladder, the indentations have an ovoid shape, and are therefore asymmetrical about at least one axis.

At least some, and preferably each, of the indentations receive an insert having a corresponding shape. The insert is designed to collapse in response to a compressive load and then recover its shape. The profile of each insert and indentation pair is configured preferably as an ovoid, for preferential collapse in a predetermined direction. That is, the two ends of the ovoid have different stiffnesses to compression. One end collapses in response to a smaller compressive load than the other end. This results in a softer feel at one end compared to the other end. In this way, the insert and indentation can be positioned in a bladder to provide the most advantageous response characteristics.

The contact area or weld between abutting indentations is larger in surface area than the welds between the prior art hemispherical indentations. In the present invention, the welds are shaped to correspond to the shape of the inserts which contributes to stability and are more resistant to oblique and eccentric loading which exert shear forces on the welds.

The bladder is constructed of barrier materials and shaped appropriately for placement in a shoe sole component. The bladder has a number of abutting indentations for receiving inserts. The insert and indentation combinations are disposed in the bladder so as to provide a desired pattern of cushioning and support in response to anticipated compressive loads. The pattern will vary depending upon the activity for which the shoe sole is designed.

Footwear, according to the present invention, can incorporate the bladder in any position along the length of the sole, and the preferential collapse of the indentations and inserts are arranged to take into account the foot motions that typically occur at that location of the sole in the type of activity for which the footwear is designed. In an illustrated example, the bladder is located in the heel of the sole and the indentations and inserts are arranged to account for lateral heel strike and pronation of the heel during running.

These and other features and advantages of the invention may be more completely understood from the following detailed description of the preferred embodiment of the invention with reference to the accompanying drawings.

BRIEF DESCRIPTION OF THE DRAWINGS

FIG. 4A is a plan view of the insert of FIG. 1 viewed from the convex side.

FIG. 4B is a plan view of the insert of FIG. 1 viewed from the concave side.

FIG. 5 is a side elevational view of the insert of FIG. 4A.

FIG. 6 is a cross-sectional view of the insert taken along line 6—6 in FIG. 4A.

FIG. 7 is a front elevational view of the insert of FIG. 4A.

FIG. 8 is a rear elevational view of the insert of FIG. 4A.

DETAILED DESCRIPTION OF THE PREFERRED EMBODIMENTS

Figure 1:
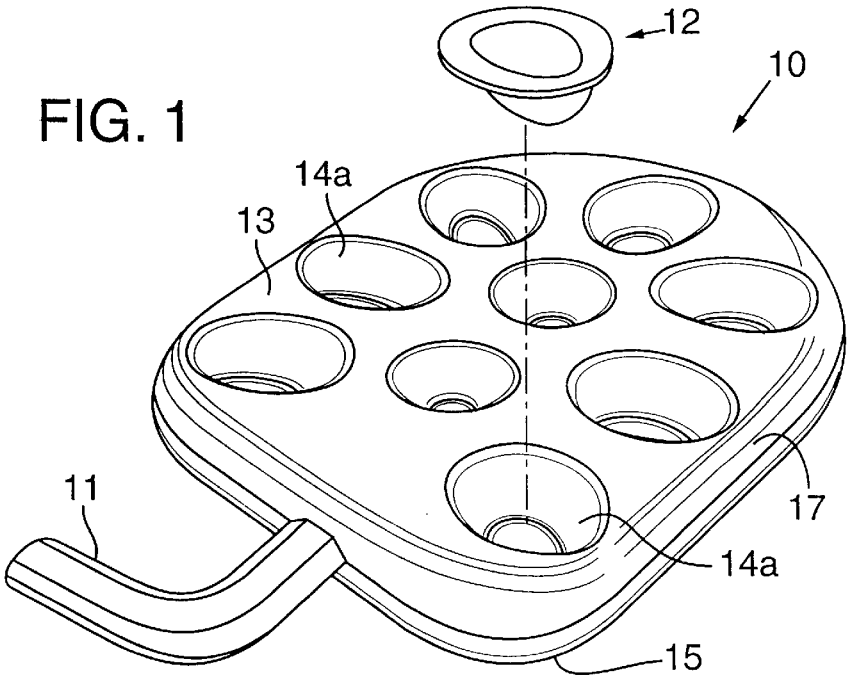
FIG. 1 is a perspective view of a rearfoot bladder and insert in accordance with the present invention.

The present invention is described with reference to a heel bladder 10 shown in FIGS. 1–3B, an insert 12 shown in FIGS. 1 and 4A–8, and footwear 80 shown in FIG. 9. With reference to FIGS. 1–3B, bladder 10 is an elastomeric member and includes upper surface 13 and lower surface 15 which are spaced from each other. Upper surface 13 and lower surface 15 are bent toward one another about their peripheries and are connected to jointly form a side surface 17 for bladder 10. Preferably, bladder 10 is formed in a conventional manner by blow molding. Bladder 10 may be made of a resilient, thermoplastic elastomeric barrier film, such as polyester polyurethane, polyether polyurethane, such as a cast or extruded ester based polyurethane film having a shore "A" hardness of 80–95, e.g., Tetra Plastics TPW-250. Other suitable materials can be used such as those disclosed in the '156 patent to Rudy. Among the numerous thermoplastic urethanes which are particularly useful in forming the film layers are urethanes such as Pellethane™, (a trademarked product of the Dow Chemical Company of Midland, Mich.), Elastollan® (a registered trademark of the BASF Corporation) and ESTANE® (a registered trademark of the B. F. Goodrich Co.), all of which are either ester or ether based and have proven to be particularly useful. Thermoplastic urethanes based on polyesters, polyethers, polycaprolactone and polycarbonate macrogels can also be employed. Further suitable materials could include thermoplastic films containing crystalline material, such as disclosed in U.S. Pat. Nos. 4,936,029 and 5,042,176 to Rudy, which are incorporated by reference; polyurethane including a polyester polyol, such as disclosed in U.S. Pat. No. 6,013,340 to Bonk et al., which is incorporated by reference; or multi-layer film formed of at least one elastomeric thermoplastic material layer and a barrier material layer formed of a copolymer of ethylene and vinyl alcohol, such as disclosed in U.S. Pat. No. 5,952,065 to Mitchell et al., which is incorporated by reference.

Bladder 10 has a number of ovoid support indentations 14*a*, 14*b* provided on the top and bottom surfaces in an abutting arrangement. Each indentation 14*a* and 14*b* can function as a carrier to receive an insert 12. Insert 12 has a shape that matingly corresponds to the shape of the indentation in which it is received. Because of this mating relationship, it is understood that a description of the shape of one applies to the other.

Figure 3A:
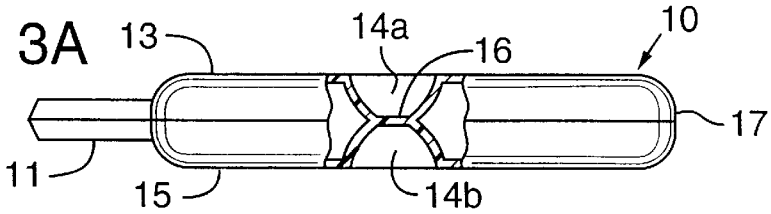
FIG. 3A is a side elevational view of the bladder of FIG. 1, shown partially in section along lines 3A—3A in FIG.2.
Figure 3B:
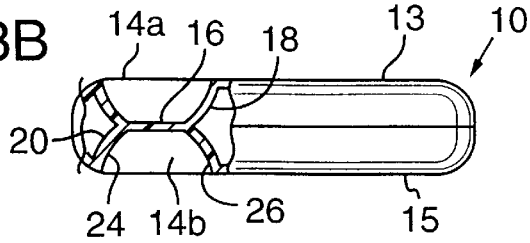
FIG. 3B is a side elevational view of the bladder of FIG. 1, shown partially in section along lines 3B—3B in FIG. 2.

Indentations 14*a*, 14*b* are formed in abutting relationship in bladder 10 as seen in FIGS. 3A and 3B. The contact area or weld 16 between the abutting indentations is formed midway into the thickness of the bladder. While FIG. 1 illustrates only one insert 12 above a single indentation 14*a*, inserts 12 can be placed in all indentations 14*a* and 14*b*, or a select number of indentations 14*a* and 14*b*, dependent on the desired amount of support needed.

For ease of explanation only, the geometry of the insert is described herein with reference to three axes. These axes are illustrated in FIG. 4B which is a plan view of the insert viewed from the concave side. The concave side of the insert is the side which faces outward when the insert is mated and placed within an indentation, and the convex side abuts against the surface of the indentation. Sometimes these sides of the insert are described herein as the top or bottom due to the orientation of the insert pictured in FIG. 1, and these directional descriptions are for convenience of reference only.

Referring to FIG. 4B, the longitudinal axis of the insert/indentation is labeled the y-axis, the lateral axis is labeled the x-axis and the orthogonal axis is labeled the z-axis. The z-axis is labeled again in FIG. 7 for clarity.

In the plan view of insert 12, the outline is generally ovoid or egg-shaped comprising arcuate ends of different radii of curvature. Like an egg, the end with the larger radius of curvature appears more rounded, and the end with the small radius of curvature appears more pointed. For ease of reference the terms rounded end 18 and pointed end 20 are used with respect to the outline of the insert/indentation. Because of these differently configured ends, in plan view inserts 12 and indentations 14*a* and 14*b* are symmetrical only about the longitudinal axis. That is, they are asymmetrical about the lateral axis and the orthogonal axis. This is in contrast to the hemispherical inserts and indentations of the prior art which were symmetrical about all three axes.

In addition to the plan view asymmetry about the lateral axis, the vertical profile of the insert and the indentations are designed with a specific geometry to provide for preferential collapse of the insert. The lateral vertical profile, as best seen in FIGS. 7 and 8, proceeds from semi-circular adjacent rounded end 18 to a portion of an ellipse adjacent pointed end 20. The longitudinal vertical profile of the insert, as best seen in FIGS. 5–6, proceeds from an almost vertical surface 24 forming the end wall at the pointed end 20, to a topmost surface 22 which is almost flat, and terminates as an inclined surface 26 which is part of an ellipsoid, at rounded end 18.

Because of the particularities of its construction, when compressed, the insert collapses more readily at rounded end 18 while pointed end 20 is stiffer. It takes increased compressive force to collapse pointed end 20. To a wearer, this results in a softer feel at rounded end 18 than at pointed end 20. In locating the inserts in a bladder, this difference in compression response can be used to optimize the cushioning and support response of the bladder. For instance, where sudden or high compressive loads are anticipated at a particular location, inserts 12 should be placed with rounded end 18 located to absorb the impact by compressing or deflecting more readily so the user feels cushioned. That is, for a given applied load, rounded end 18 can deflect more than point end 20 and cause the impact to be spread over a longer period of time, resulting in a smaller impact force upon the wearer's foot. Rounded end 18 thus provides enhanced cushioning over pointed end 20, while pointed end 20 provides enhanced stability over rounded end 18.

Figure 2:
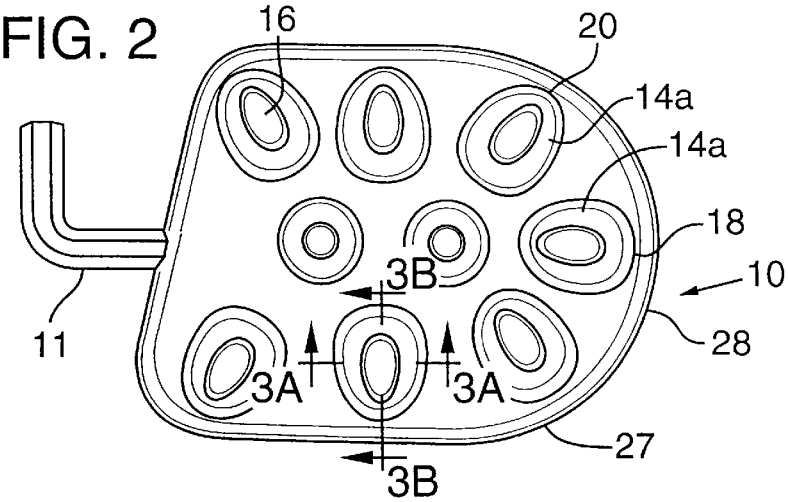
FIG. 2 is a top plan view of the bladder of FIG. 1.

In the preferred embodiment, heel bladder 10, FIG. 2, is for a left running shoe and lateral rear 27 and rear end 28 would tend to take the initial impact of footstrike. Indentations and inserts are placed with rounded ends 18 closest to lateral rear 27 and rear end 28 to collapse upon heelstrike and cushion the wearer, while pointed ends 20, which are stiffer, are directed toward the center of heel bladder 10 to support and stabilize the load. Along the more forward lateral edge and the medial edge of heel bladder 10, the indentations and inserts are placed with their pointed ends closest to the edges, and the rounded ends directed toward the center. Since the pointed ends 20 are stiffer, this configuration provides lateral and medial stability to prevent excessive pronation or supination, with enhanced cushioning of the rounded ends 18 in the center heel area under the calcaneus.

Figure 9:
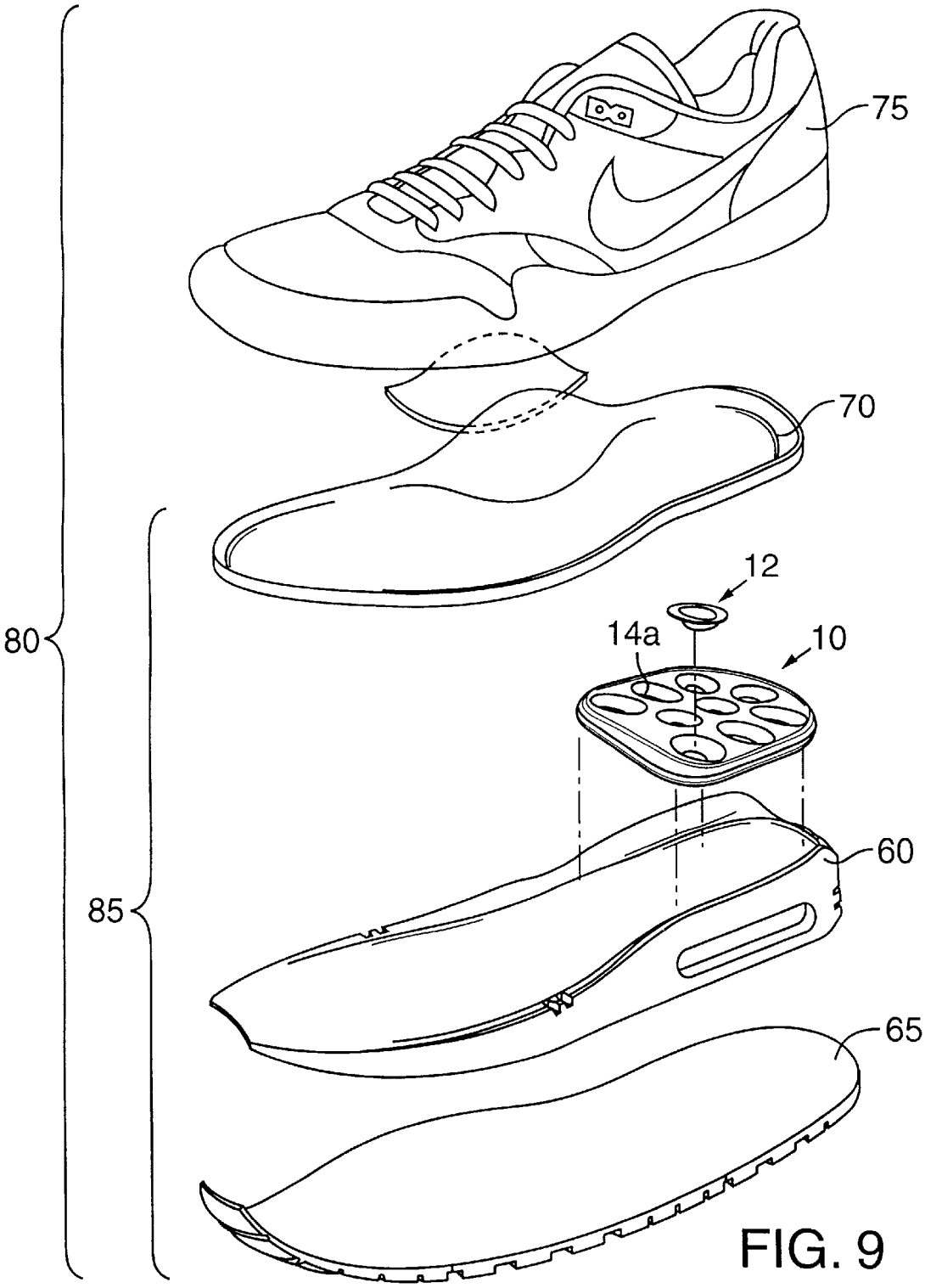
FIG. 9 is an exploded perspective view of an article of footwear incorporating the bladder of FIG. 2 in the sole.

FIG. 9 is an exploded perspective view of an article of footwear, a shoe 80 incorporating heel bladder 10. Shoe 80 is comprised of an upper 75 for covering a wearer's foot and a sole assembly 85. Sole assembly 85 comprises an insole or sockliner 70 inserted into upper 75, a midsole 60 attached to the bottom of upper 75, and an outsole 65 attached to the bottom of midsole 60. Bladder 10, with one or more inserts 12 (only one of which is shown), is preferably incorporated into the sole assembly 85 as shown diagrammatically. Bladder 10 can be incorporated into midsole 60 by any conventional technique such as foam encapsulation or placement in a cut-out portion of a foam midsole. A suitable foam encapsulation technique is disclosed in U.S. Pat. No. 4,219,945 to Rudy, hereby incorporated by reference.

Bladders can be customized for different activities based on the principles applied in configuring heel bladder 10. The rounded ends are positioned where high loads are experienced, and the pointed ends are positioned where stability is desired.

Another factor contributing to stability and durability of the bladder is the relative size and the shape of contact areas 16 between abutting indentations. Flattened topmost surfaces 22 afford a large surface area for joining the top and bottom surfaces of the bladder. The relatively large welds or contact areas are more resistant to shear failure from oblique compressive loads, and also allow placement of the ovoid indentations closer to the edge of the bladder than the hemispherical indentations of the prior art because the deeper draw of the ends of the ovoid indentations places the welds closer to the edge of the bladder. As can be seen in the drawings, the welds are shaped to correspond to the shape of the ovoid outline. This also contributes to the stability and durability of the bladder since oblique loads which impart shear forces to the bladder will either be exerted along the longitudinal axis or the lateral axis of the welds. In either alignment, the ovoid weld areas provide an increased resistance to shear failure over the circular or dot weld of the conventional hemispherical indentations.

Bladder 10 can be sealed to hold air or other fluid at ambient pressure, or can be pressurized with an appropriate fluid, for example, hexafluorethane, sulfur hexafluoroide, nitrogen, air, or other gases such as those disclosed in the aforementioned '156, '945, '029, or '176 patents to Rudy, or the '065 patent to Mitchell et al. If pressurized, the fluid or gas can be placed in bladder 10 through an inflation tube 11 in a conventional manner by means of a needle or hollow welding tool. After inflation, the bladder can be sealed at the juncture of the body of bladder 12 and inflation tube 11, and the remainder of tube 11 can be cut off. Alternatively, tube 11 can be sealed by the hollow welding tool around the inflation point.

One of the factors that affects the response characteristics of the inserts is the material from which they are constructed. An understanding of the physical properties of the inserts begins with an understanding of the role and behavior of gas in shoe sole bladder components. Gas as a cushioning medium is energy efficient. That is, it recovers quickly from compression. In the bladder of the present invention, the volume occupied by the indentations reduces the overall volume of the gas in the bladder. Because gas, an energy efficient medium, is displaced in favor of the indentations, the inserts must also be energy efficient to exhibit cushioning characteristics which resemble those of gas. The inserts are preferably made of a material which has a high energy efficiency, i.e., low hysteretic losses in the material allow it to return to its unstressed state quickly and without energy loss.

In the preferred embodiment, the bladder is comprised of polyurethane film, and the inserts are made of a nylon base polymer such as Pebax 3533 manufactured by Atochem of Paris, France. Nylon base polymers such as Pebax are energy efficient, and recover quickly after deformation. With the combination gas in the bladder and the inserts, the response of the bladder of the preferred embodiment is approximately 80% mechanical and 20% pneumatic.

Among the parameters of designing the inserts, the most sensitive parameter to altering and adjusting the response characteristics is the thickness. The thickness is determined for an anticipated load and the types of loads, whether sporadic or cyclical. For example, the inserts for a basketball shoe would be thicker than those for a running shoe because basketball players are generally heavier and load five to seven times their body weight in jumping, while runners are generally lighter and load only two to three times their body weight. For different sports, a typical range of thicknesses would be between 0.5 and 3.0 mm.

From the foregoing detailed description, it will be evident that there are a number of changes, adaptations, and modifications of the present invention which come within the province of those skilled in the art. However, it is intended that all such variations not departing from the spirit of the invention be considered as within the scope thereof as limited solely by the claims appended hereto.

We claim:

1. A fluid filled cushioning member for a shoe sole comprising a fluid containing outer wall having a deformable indentation forming an indented wall portion in said outer wall and opening to an outer surface of said outer wall, said indentation having longitudinal and lateral axes defined generally along said outer surface and an orthogonal axis perpendicular to said longitudinal and lateral axes, said indented wall portion of said indentation being asymmetrical about at least one of said longitudinal, lateral and orthogonal axes.

2. The fluid filled cushioning member of claim 1, wherein said indented wall portion of said indentation is asymmetrical about said lateral axis.

3. A fluid filled cushioning member of claim 1, wherein said indented wall portion of said indentation is asymmetrical about said orthogonal axis.

4. The fluid filled cushioning member of claim 2, wherein said indented wall portion of said indentation is asymmetrical about said orthogonal axis.

5. The fluid filled cushioning member of claim 1, further comprising a plurality of said indentation in said outer wall of said cushioning member.

6. The fluid filled cushioning member of claim 1, wherein said indentation is disposed in a top surface of said outer wall.

7. The fluid filled cushioning member of claim 1, wherein said indentation is disposed in a bottom surface of said outer wall.

8. The fluid filled cushioning member of claim 1, wherein said indentation is disposed in a top surface of said outer wall and a corresponding indentation disposed in a bottom surface of said outer wall to abut said indentation of said top surface.

9. The fluid filled cushioning member of claim 8, wherein said abutting indentations are attached in a contact area.

10. The fluid filled cushioning member of claim 9, wherein said contact area defines a shape corresponding to the shape of at least one of said indentations at a surface of said cushioning member.

11. The fluid filled cushioning member of claim 8, further comprising a plurality of abutting indentations in said top and bottom surfaces of said cushioning member.

12. The fluid filled cushioning member of claim 1, wherein said indentation defines an ovoid shape at the outer surface with first and second ends, said first end deformable at a lower compressive load than said second end.

13. The fluid filled cushioning member of claim 12, wherein said ovoid shape comprises at said first end a first arc, and at said second end a second arc, said first arc having a radius of curvature greater than said second arc.

14. The fluid filled cushioning member of claim 12, wherein said indentation has a deeper draw at said second end than at said first end resulting in a more vertical surface at said second end to provide a stiffer response to a compressive load.

15. The fluid filled cushioning member of claim 12, further comprising a plurality of said indentation.

16. The fluid filled cushioning member of claim 15, wherein said indentations are disposed in a top surface of said cushioning member.

17. The fluid filled cushioning member of claim 15, wherein said indentations are disposed in a bottom surface of said cushioning member.

18. The fluid filled cushioning member of claim 15, wherein said indentations are disposed in a top surface and corresponding indentations are disposed in a bottom surface to abut said indentations in said top surface.

19. The fluid filled cushioning member of claim 18, wherein said abutting indentations are attached in a contact area.

20. The fluid filled cushioning member of claim 19, wherein said contact area defines an ovoid shape.

21. The fluid filled cushioning member of claim 15, having a configuration to be inserted in a heel area of a sole of an article of footwear, wherein on a lateral heel side the first end of at least one of said indentations is disposed adjacent to an outer lateral side of said cushioning member.

22. The fluid filled cushioning member of claim 1 in combination with an article of footwear comprising an upper and a sole attached to said upper, wherein said fluid filled cushioning member is part of said sole.

23. A resilient support member for insertion in a fluid filled cushioning member of a shoe sole, said support member being formed of a resilient material and being deformable under compressive loading and recovering to substantially its original shape after the compressive loading is removed, said support member being formed as an indentation from an outer surface of said resilient material, said indentation having longitudinal and lateral axes defined generally along said outer surface and an orthogonal axis perpendicular to such longitudinal and lateral axes, a surface of said indentation being asymmetrical about at least one of said longitudinal, lateral and orthogonal axes.

24. The support member of claim 23, wherein said surface of said support member is asymmetrical about said lateral axis.

25. The support member of claim 23, wherein said surface of said support member is asymmetrical about said orthogonal axis.

26. The support member of claim 24, wherein said surface of said support member is asymmetrical about said orthogonal axis.

27. The support member of claim 23, wherein said support member defines an ovoid shape with first and second ends, said first end deformable at a lower compressive load than said second end.

28. The support member of claim 27, wherein said ovoid shape comprises at said first end a first arc, and at said second end a second arc, said first arc having a radius of curvature greater than said second arc.

29. The support member of claim 27, wherein said support member has a deeper draw at said second end than at said first end resulting in a more vertical surface at said second end to provide a stiffer response to a compressive load.

30. The support member of claim 23 in combination with a fluid filled cushioning member and an article of footwear, wherein said support member is inserted into an indentation in said fluid filled cushioning member and said fluid filled cushioning member is part of a sole of said article of footwear.

31. A component for a sole of an article of footwear comprising:

a fluid filled cushioning member formed of a fluid containing outer wall having an indentation in an outer surface of said outer wall; and a resilient support member having a shape corresponding to said indentation, said support member adapted to be matingly received in said indentation, the mated indentation and support member defining a mated shape having longitudinal and lateral axes generally along a surface of said cushioning member and an orthogonal axis perpendicular to said longitudinal and lateral axes, said mated shape being asymmetrical about at least one of said longitudinal, lateral and orthogonal axes.

32. The component of claim 31, wherein said mated shape is asymmetrical about said lateral axis.

33. The component of claim 31, wherein said mated shape is asymmetrical about said orthogonal axis.

34. The component of claim 32, wherein said mated shape is asymmetrical about said orthogonal axis.

35. The component of claim 31, further comprising a plurality of indentations and support members to provide a plurality of said mated shapes.

36. The component of claim 31, wherein said indentation and said support member are disposed in a top surface of said component.

37. The component of claim 31, wherein said indentation and said support member are disposed in a bottom surface of said component.

38. The component of claim 31, wherein said indentation and said support member are disposed in a top surface of said component, a corresponding indentation and support member are disposed in a bottom surface of said component, and said indentation in said top surface abuts said corresponding indentation in said bottom surface.

39. The component of claim 38, wherein said abutting indentations are attached in a contact area.

40. The component of claim 39, wherein said contact area defines a shape corresponding to said mated shape.

41. The component of claim 38, further comprising a plurality of abutting indentations in the top and bottom surfaces of said component with mated support members disposed therein.

42. The component of claim 31, wherein said indentation defines an ovoid shape at said outer surface with first and second ends, said first end deformable at a lower compressive load than said second end.

43. The component of claim 42, wherein said ovoid shape comprises at said first end a first arc, and at said second end a second arc, said first arc having a radius of curvature greater than said second arc.

44. The component of claim 42, wherein said indentation has a deeper draw at said second end than at said first end resulting in a more vertical surface at said second end to provide a stiffer response to a compressive load.

45. The component of claim 42, further comprising a plurality of said indentations and mating support members.

46. The component of claim 42, wherein said indentation is disposed in a top surface and a corresponding indentation is disposed in a bottom surface to abut said indentation in said top surface.

47. The component of claim 46, wherein said abutting indentations are attached in a contact area.

48. The component of claim 47, wherein said contact area defines an ovoid shape.

49. The component of claim 45 having a configuration to be inserted in a heel area of a sole of an article of footwear, wherein on a lateral heel side the first end of at least one of said indentations is disposed adjacent an outer lateral heel side of said component.

50. The component of claim 31 in combination with an article of footwear comprising an upper and a sole attached to the upper wherein said component is part of said sole.

51. A component for a sole of an article of footwear comprising:

a fluid filled cushioning member formed of a fluid containing outer wall having a plurality of paired ovoid indentations in said outer wall opening to opposed surfaces of said member, said paired indentations abutting one another and attached to one another in a contact area; and a plurality of correspondingly shaped inserts matingly disposed in said indentations, said indentations and inserts deformable upon compressive loading and recovering to substantially their original shape in an unloaded state.

52. The component of claim 51, wherein each said ovoid indentation defines a longitudinal, lateral and orthogonal axes at an outer surface of said cushioning member, said ovoid indentation being asymmetrical about at least one of said longitudinal, lateral and orthogonal axes.

53. The component of claim 52, wherein said ovoid indentations each comprise a first end and a second end, said first end being deformable at a lower compressive load than said second end.

54. The component of claim 53, wherein said first end comprises a first arc, and said second end comprises a second arc, said first arc having a radius of curvature greater than said second end.

55. The component of claim 51 in combination with an article of footwear comprising an upper and a sole attached to said upper, wherein said component is part of said sole.

56. An article of footwear comprising:

an upper for covering at least a portion of a wearer's foot;

a sole attached to said upper, said sole comprising:

a fluid filled cushioning member formed of a fluid containing outer wall having a plurality of paired ovoid indentations in said outer wall opening to opposed surfaces of said member, said paired indentations abutting one another and attached to one another in an ovoid contact area; and a plurality of correspondingly shaped inserts matingly disposed in said indentations, said indentations and inserts deformable upon compressive loading and recovering to substantially their original shape in an unloaded state.

57. The article of footwear of claim 56, wherein said ovoid indentations each comprise a first end and a second end, said first end being deformable at a lower compressive load than said second end.

58. The article of footwear of claim 57, wherein said first end comprises a first arc, and said second end comprises a second arc, said first arc having a radius of curvature greater than said second end.

59. The article of footwear of claim 57 wherein said cushioning member is located in a heel area of said sole, and in a lateral heel side the first end of at least one of said paired ovoid indentations is disposed adjacent an outer lateral heel side of said sole.

60. A fluid filled cushioning member for a shoe sole comprising a fluid containing outer wall having a deformable indentation formed in said outer wall and opening to an outer surface of said outer wall, said indentation having longitudinal, lateral and orthogonal axes defined at said outer surface and being asymmetrical about at least one of said longitudinal, lateral and orthogonal axes;

wherein said indentation defines an ovoid shape at the outer surface with first and second ends, said first end deformable at a lower compressive load than said second end, and said indentation has a deeper draw at said second end than at said first end resulting in a more vertical surface at said second end to provide a stiffer response to a compressive load.

61. A fluid filled cushioning member for a shoe sole comprising a fluid containing outer wall having a deformable indentation formed in said outer wall and opening to an outer surface of said outer wall, said indentation having longitudinal, lateral and orthogonal axes defined at said outer surface and being asymmetrical about at least one of said longitudinal, lateral and orthogonal axes;

wherein said indentation defines a ovoid shape at the outer surface with first and second ends, and said indentation has a deeper draw at said second end than at said first end resulting in a more vertical surface at said second end.

62. A resilient support member for insertion in a fluid filled cushioning member of a shoe sole, said support member being formed of a resilient material and being deformable under compressive loading and recovering to substantially its original shape after the compressive loading is removed, said support member having longitudinal, lateral and orthogonal axes and being asymmetrical about at least one of said longitudinal, lateral and orthogonal axes;

wherein said support member defines an ovoid shape with first and second ends, said first end deformable at a lower compressive load than said second end, and said support member has a deeper draw at said second end than at said first end resulting in a more vertical surface at said second end to provide a stiffer response to a compressive load.

63. A component for a sole of an article of footwear comprising:

a fluid filled cushioning member formed of a fluid containing outer wall having an indentation in an outer surface of said outer wall; and a resilient support member having a shape corresponding to said indentation, said support member adapted to be matingly received in said indentation, the mated indentation and support member defining a mated shape having longitudinal, lateral and orthogonal axes at a surface of said cushioning member, said mating shape being asymmetrical about at least one of said longitudinal, lateral and orthogonal axes;

wherein said indentation defines an ovoid shape at said outer surface with first and second ends, said first end deformable at a lower compressive load than said second end, and said indentation has a deeper draw at said second end than at said first end resulting in a more vertical surface at said second end to provide a stiffer response to a compressive load.

64. A component for a sole of an article of footwear comprising:

a fluid filled cushioning member formed of a fluid containing outer wall having a plurality of paired ovoid indentations in said outer wall opening to opposed surfaces of said member, said paired indentations abutting one another and attached to one another in a contact area; and a plurality of correspondingly shaped inserts matingly disposed in said indentations, said indentations and inserts deformable upon compressive loading and recovering to substantially their original shape in an unloaded state;

wherein said ovoid indentations each comprise a first end and a second end, said first end being deformable at a lower compressive load than said second end, and said ovoid indentations have a deeper draw at said second end than at said first end resulting in a stiffer response to deformation at said second end.

65. An article of footwear comprising:

an upper for covering at least a portion of a wearer's foot;

a sole attached to said upper, said sole comprising:

a fluid filled cushioning member formed of a fluid containing outer wall having a plurality of paired ovoid indentations in said outer wall opening to opposed surfaces of said member, said paired indentations abutting one another and attached to one another in an ovoid contact area; and a plurality of correspondingly shaped inserts matingly disposed in said indentations, said indentations and inserts deformable upon compressive loading and recovering to substantially their original shape in an unloaded state;

wherein said ovoid indentations each comprise a first end and a second end, said first end being deformable at a lower compressive load than said second end, and wherein said ovoid indentations have a deeper draw at said second end than at said first end resulting in a stiffer response to deformation at said second end.

66. An article of footwear comprising:

an upper for covering at least a portion of a wearer's foot;

a sole attached to said upper, said sole comprising:

a fluid filled cushioning member formed of a fluid containing outer wall having at least one deformable indentation in said outer wall and opening to an outer surface of said wall, said at least one indentation having longitudinal, lateral and orthogonal axes defined at said outer surface and being asymmetrical about at least one of said longitudinal, lateral and orthogonal axes;

wherein said at least one indentation defines and ovoid shape with first and second ends, said first end being deformable at a lower compressive load than said second end, and wherein said at least one indentation has a deeper draw at said second end than at said first end resulting in a stiffer response to deformation at said second end.

* * * * *